US006312048B1

(12) United States Patent
Kilmer

(10) Patent No.: US 6,312,048 B1
(45) Date of Patent: Nov. 6, 2001

(54) ASSEMBLY FOR CONVERTING A FOLDING ALUMINUM BEACH CHAIR INTO A WHEELED CART FOR TOTING BEACH ITEMS AND THE LIKE

(75) Inventor: Thomas K. Kilmer, Souderton, PA (US)

(73) Assignee: Sterling Suma, Ltd., Souderton, PA (US)

( * ) Notice: Subject to any disclaimer, the term of this patent is extended or adjusted under 35 U.S.C. 154(b) by 0 days.

(21) Appl. No.: 09/562,993

(22) Filed: May 1, 2000

(51) Int. Cl.[7] ..... A47C 13/00
(52) U.S. Cl. ..... 297/129
(58) Field of Search ..... 297/130, 118, 297/35, 16.1; 280/47.131, 30, 47.25; 29/428

(56) References Cited

U.S. PATENT DOCUMENTS 4,376,547 * 3/1983 Dominko .
4,934,719 * 6/1990 DuPont .
5,062,650 * 11/1991 Chang .
5,356,160 * 10/1994 Urlwin .
5,362,079 * 11/1994 Graham .
5,364,112 * 11/1994 Jackson .
5,492,347 * 2/1996 Palmeri et al. .
6,003,883 * 12/1999 Brenneman .

* cited by examiner

*Primary Examiner*—Milton Nelson, Jr.
(74) *Attorney, Agent, or Firm*—Volpe & Koenig, P.C.

(57) ABSTRACT

Wheel assemblies and more particularly, light weight wheel assemblies including mounting brackets for mounting the wheel assemblies to a folding aluminum chair for converting the beach chair into a wheeled tote.

9 Claims, 4 Drawing Sheets

ASSEMBLY FOR CONVERTING A FOLDING ALUMINUM BEACH CHAIR INTO A WHEELED CART FOR TOTING BEACH ITEMS AND THE LIKE

FIELD OF THE INVENTION

BACKGROUND OF THE INVENTION

Folding aluminum beach chairs are favored by attendees at sporting events and by beach goers due to their light weight. Nevertheless, such beach chairs are bulky and in instances where it is either desirable or necessary to carry a number of items to the beach, such as beach chairs, beach umbrellas, beach towels, picnic items and the like, these items can be awkward, clumsy and heavy to carry and manipulate.

BRIEF DESCRIPTION OF THE INVENTION

The present invention is characterized by comprising a kit provided with wheeled assemblies for simply and easily converting a folding aluminum beach chair into a wheeled tote capable of carrying bulky and clumsy beach items to the beach or to other events using bungee cords to hold down the items being toted.

The beach chair is a conventional beach chair formed of aluminum tubing sections pivotally connected to one another to define a seat portion, back portion and a pair of substantially U-shaped leg portions and preferably, arm portions. Fabric or plastic webs are arranged across the seat and back portions to form surfaces for supporting the body and back of a user.

The wheeled assemblies are clampingly mounted to the rear leg portion of the beach chair so as to be retained on the arms of the U-shaped portion while being slidable thereal-ong.

An extension is also clamped to each bracket assembly, the extensions of each having an opening for receiving an axle. A pair of wheels are provided on each axle on opposite sides of the extension and locking end caps are snap-fitted thereto.

The wheels are positioned along the rear side of the beach chair so that they do not touch the supporting surface upon which the chair is positioned while assuring that only the wheels engage the ground when the beach chair is folded to the collapsed position and tilted rearwardly, enabling the beach chair to be wheeled from place to place or, in addition thereto, enabling the collapsed beach chair to serve as a wheeled tote to carry items to the beach or elsewhere by laying these items upon the supporting webs and holding the items down with bungee cords.

In order to be assured that the wheels are arranged in the proper position, the brackets which are slidably mounted to the rear leg portion of the beach chair are, after being properly positioned, secured in the desired position by self-tapping screws extending through openings in the brackets and being secured to the tubular leg. Similar self-tapping screws are provided to maintain the aforesaid extension at the proper position after the extensions are moved to the desired location projecting from the bracket assemblies.

The bracket assemblies are light in weight and do not interfere with the normal use of the beach chair in either the upright or collapsed positions.

OBJECTS OF THE INVENTION

It is therefore one object of the present invention to provide a novel assembly for converting a foldable beach chair into a wheeled tote.

Still another object of the present invention is to provide a novel wheel assembly for mounting to a foldable beach chair and which is capable of placing the wheels upon the beach chair so that they do not interfere with the normal use of the beach chair and are active when the beach chair is folded and tilted rearwardly enabling the beach chair to be used as a wheeled tote or for purposes of wheeling the beach chair from one location to another.

BRIEF DESCRIPTION OF THE FIGURES

The above, as well as other objects of the present invention will become apparent when reading the accompanying description and drawings in which.

DETAILED DESCRIPTION OF THE INVENTION AND PREFERRED EMBODIMENTS THEREOF

Figure 1A:
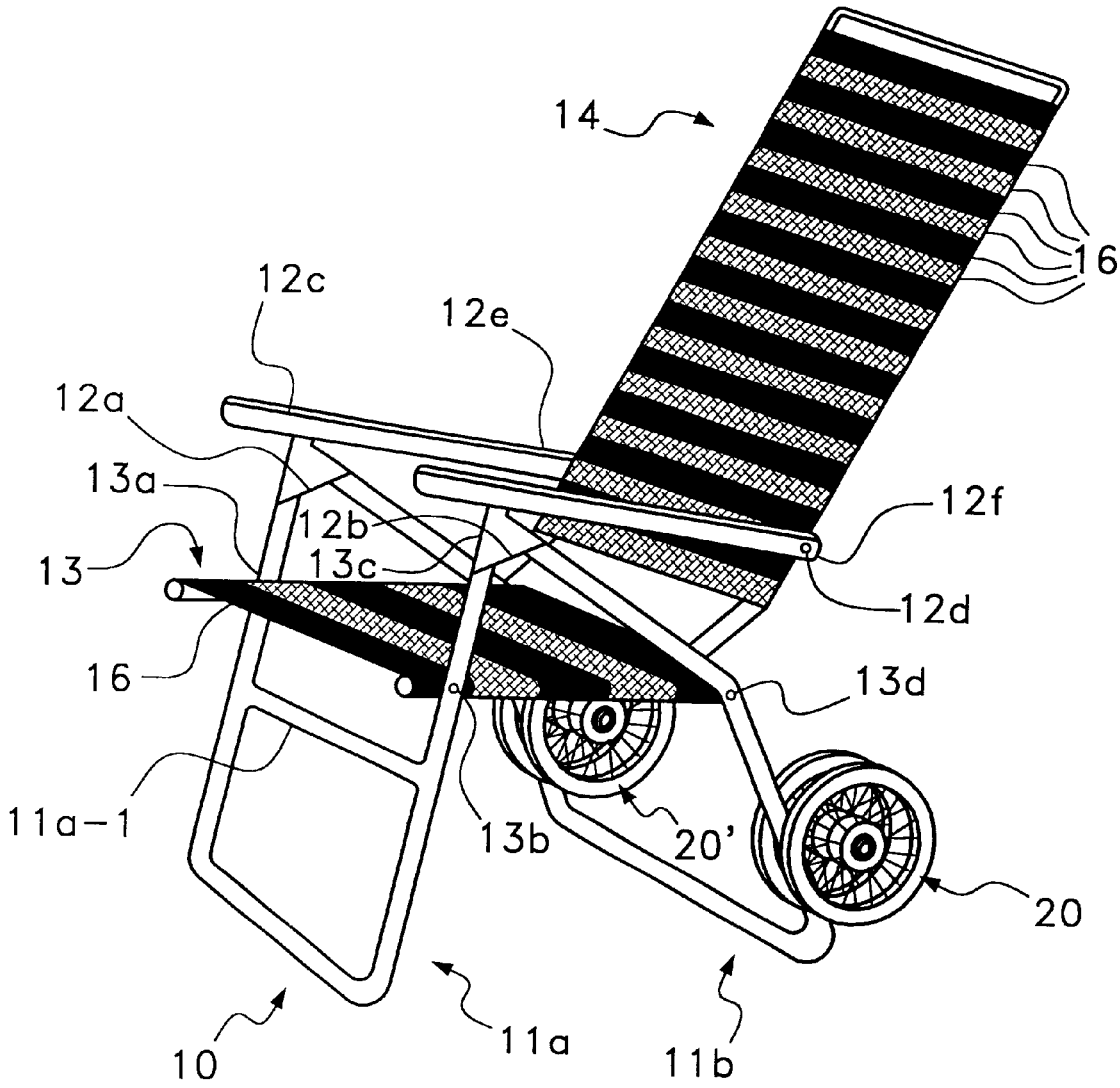
FIG. 1*a* shows an aluminum beach chair having the bracket assemblies of the present invention mounted thereto, with the beach chair shown in the open position for use.
Figure 1B:
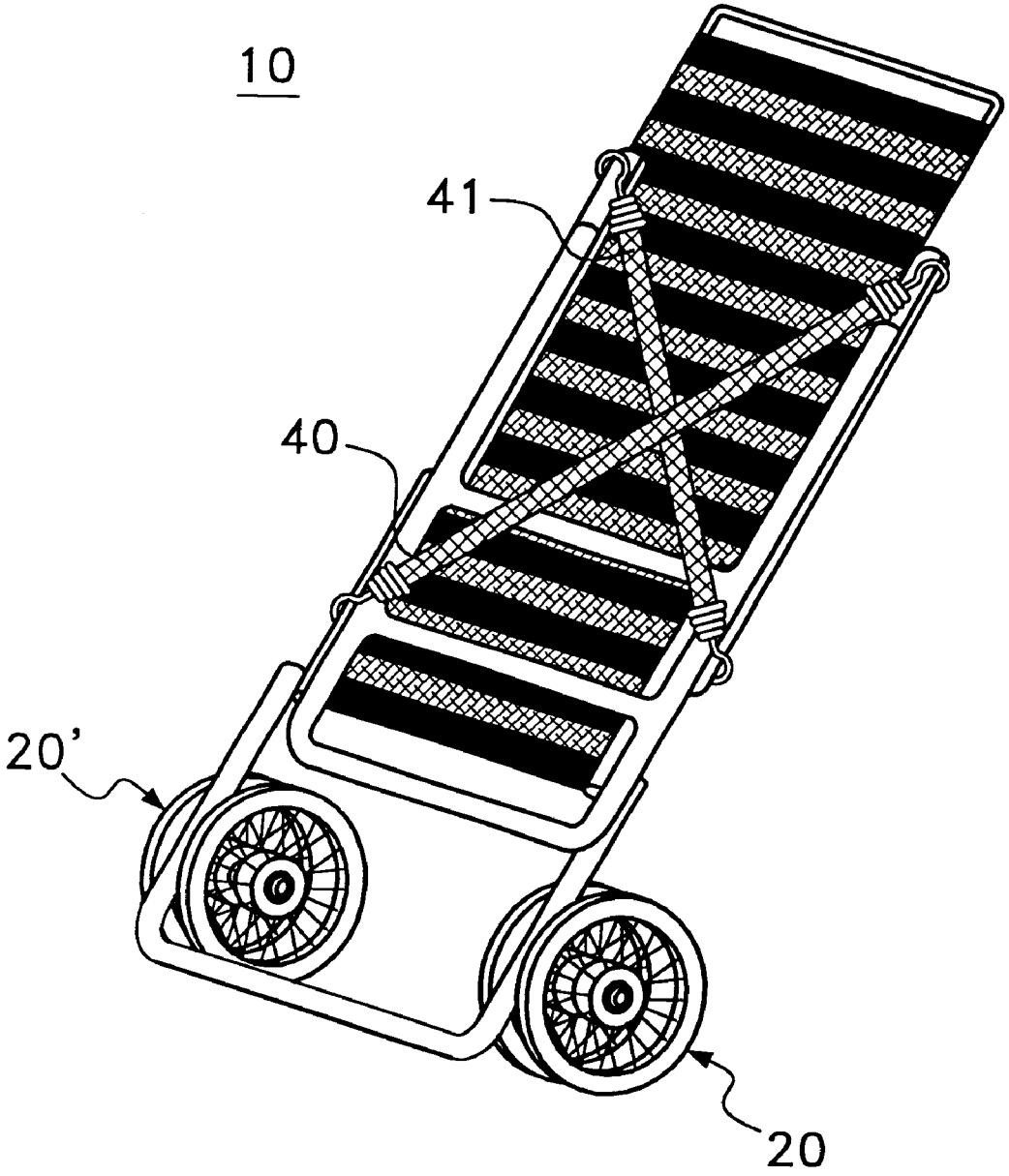
FIG. 1*b* is a perspective view showing the beach chair of FIG. 1*a* in the folded position for use as a wheeled tote.

FIGS. 1*a* and 1*b* show a folding aluminum beach chair 10 to which the bracket assemblies of the present invention are mounted for converting the chair into a wheeled tote.

The chair 10 is comprised of first and second substantially U-shaped leg sections 11*a* and 11*b*, pivotally mounted to one another through brackets 12*a*, 12*b* forming integral parts of arm-rest portions 12*c*, 12*d*. The leg sections 11*a* and 11*b* are further pivotally connected to the rear end of a seat section 13, front leg section 11*a* being connected to seat section 13 at pivots 13*a*, 13*b* and rear leg section 11*b* being connected to the rear end of seat section 13 at 13*c*, 13*d*. The rear of seat section 13 is connected to the lower end of a back section 14 at pivot points 13*c*, 13*d*. Back section 14 is further connected to the arm rest sections 12*c* and 12*d* at pivots 12*e*, 12*f*.

Each of the sections 11*a*, 11*b*, 13 and 14 are formed of a suitable hollow, aluminum tubing having cross pieces, such as, for example, the cross-piece 11*a*-1, to provide added structural strength.

Seat section 13 and back section 14 are each provided with a plurality of webs 16 which are arranged in spaced parallel fashion so as to form a support for the seat and back of a person sitting upon the chair when in the upright and open position, shown in FIG. 1*a*. The webs 16 may be joined in any suitable fashion to the seat and back sections 13 and 14 and the manner of their joining lends no novelty to the present invention other than to serve the dual function of providing a support for the body of a person seated upon the chair and further for providing a surface upon which items to be transported may be arranged. If desired, the webs can be arranged on the chair in criss-cross fashion, as is another conventional arrangement.

FIG. 1*b* shows the beach chair in the folded position.

As can be seen in FIGS. 1*a* and 1*b*, the chair 10 has been fitted with a pair of wheeled assemblies 20, 20'. For simplicity, only one of these wheeled assemblies will be described in detail, it being understood that both wheeled assemblies are substantially identical in design and function.

The wheeled assembly 20, for example, is comprised of a pair of bracket halves 22, 24, shown in FIGS. 4*b* and 5*a*–5*c*. The bracket halves are formed of any suitable material such as a light-weight, rugged metal or plastic.

Each bracket half has a first and second semicylindrical portion 22*a*, 22*b* and 24*a*, 24*b* so that, when the bracket halves are arranged adjacent to one another, as show in FIGS. 4*b* and 5*a*–5*c*, the semi-cylindrical halves cooperate to form a hollow, cylindrical receiving opening for embracing a leg.

Each of the bracket halves is further provided with integral, pie-shaped sections 22*c*, 24*c* arranged along inside corners of the bracket assembly. Each of these pie-shaped sections is provided with an opening for receiving a bracket screw BS, as shown in FIGS. 2*c* and 3*c*, extending through the openings provided in the pie-shaped sections and receiving, at the free, threaded end, a bracket washer W, as shown in FIGS. 2*d* and 3*d* and a bracket nut N, as shown in FIGS. 2*e* and 3*e*, for securing the brackets to one another.

Each bracket half is further provided with a plurality of tabs 22*d*, 24*d* and 22*e*, 24*e* arranged along opposite sides of the pie-shaped sections as well as tabs 22*f*, 22*g* and 24*f*, 24*g* arranged along the opposite sides of the semi-cylindrical portions 22*a*, 24*a*, 22*b*, 24*b*.

Figure 2A:
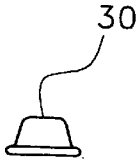
FIGS. 2*a*–2*e* are side views showing some of the components of the present invention.
Figure 3A:
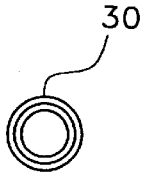
FIGS. 3*a*–3*e* show top views of the respective components shown in FIGS. 2*a*–2*e;*
Figure 2B:
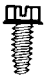
Figure 3B:
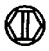
Figure 2C:
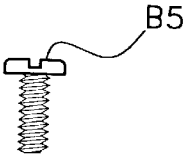
Figure 3C:
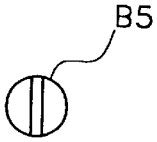
Figure 2D:
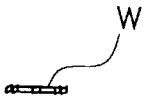
Figure 3D:
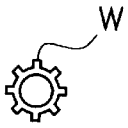
Figure 2E:
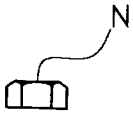
Figure 3E:
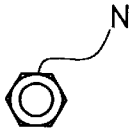

Each of these tabs receives a bracket screw BS as shown in FIGS. 2*c* and 3*c*, bracket washer W, as shown in FIGS. 2*d* and 3*d*, and a bracket nut N, as shown in FIGS. 2*e* and 3*e* in order to securely fasten the bracket assembly 22 to one integral arm of the leg section 11*b*.

Figure 4A:
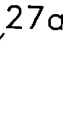
FIGS. 4*a*–4*f* are perspective views showing additional components of the bracket assemblies of the present invention.
Figure 4B:
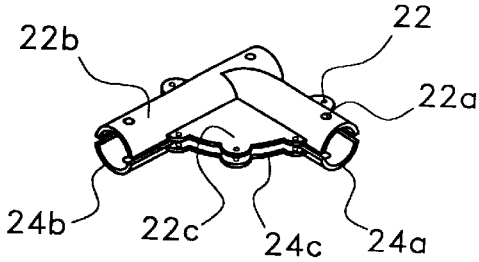
Figure 4C:
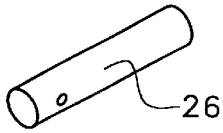
Figure 4D:
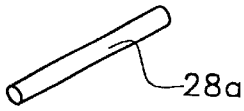
Figure 4E:
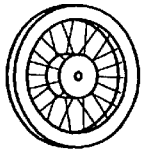
Figure 4F:
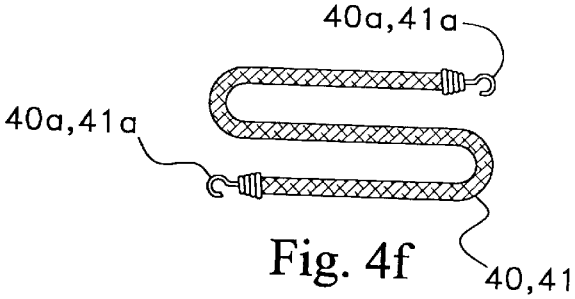
Figure 5A:
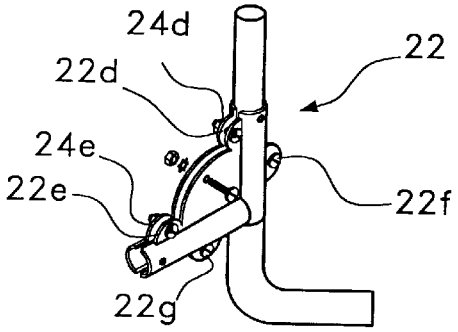
FIGS. 5*a*–5*c* are perspective views and FIG. 5*d* is a simplified side view of the bracket assemblies of the present invention useful in describing the manner in which the bracket assemblies are mounted to the folding beach chair.
Figure 5C:
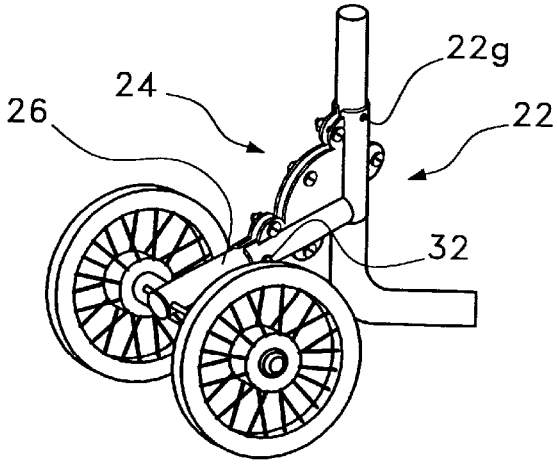
Figure 5B:
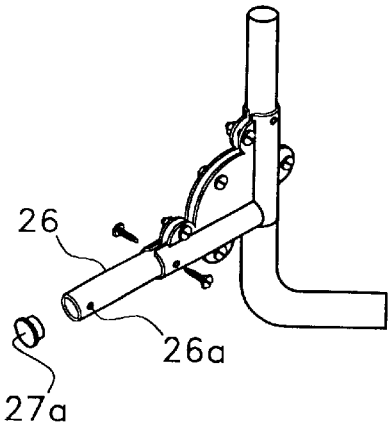

Each of the bracket assemblies 20 and 20' are mounted in a like fashion. Each of the aluminum extension struts 26 is slidably inserted within the cooperating semi-cylindrical halves 22*b*, 24*b* of bracket halves 22 and 24, as shown in FIG. 5*b*. An end cap 27*a*, shown in FIGS. 4*a*, 5*b* and 5*c* is snap-fitted into the open end of each of the aluminum struts 26 near the end which is closer to the openings 26*a*, extending through hollow aluminum strut 26.

Figure 5D:
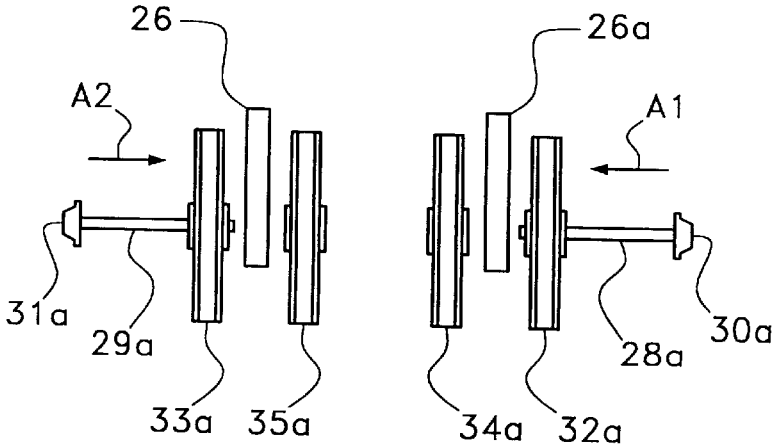

An aluminum axle 28*a*, 29*a* is extended through each of the struts 26, 26 in the direction shown by the arrows A1, A2, in FIG. 5*d*, with the axles arranged on the outside sides of the struts and being moved toward one another, as shown.

An axle cap 30, as shown in FIGS. 2*a* and 3*a*, is tapped onto one end of each axle, preferably using a hammer.

The uncapped end of each axle is then moved in the direction shown by arrows A1, A2, so as to be inserted through the central openings in a first wheel 32*a*, 33*a* and then passed through the appropriate openings in struts 26, 26 and thereafter passed through the central openings in wheels 34*a*, 35*a*. Another axle cap 30 of the type shown in FIGS. 2*a* and 3*a* is then mounted to the opposite end of the axles to retain the wheels on each of their respective axles.

When both sets of wheels have been affixed to the struts 26, 26, they are then properly aligned with the back of the folding chair so that the bottom of the wheels do not extend below the end of the chair legs, as shown in FIGS. 1*a* and 1*b*. When the brackets are positioned at the proper height, the brackets are secured to the chair legs with self tapping screws of the type shown in FIGS. 2*b* and 3*b*, which self tapping screws are inserted through at least the opening 22*g* in bracket 22, as shown in FIG. 5*c*. The struts 26*a* and 27 are likewise slidable within the semi-cylindrical portions 22*b*, 24*b* and the struts are slidably moved in order to be assured that the wheels are aligned. When the wheels are so aligned, a self tapping screw, such as, for example, self tapping screw 39, as shown in FIG. 3, is inserted through an opening in each bracket 22, 24 to retain the alignment of wheel assembly mounted to brackets 22, 24. A similar alignment and securement is made with respect to the other assembly 20'.

With the arrangement as shown and the wheeled assemblies properly aligned, it can be seen in FIG. 1*b* that the wheels do not engage the surface upon which the chair is supported thereby assuring that the chair will be stably supported on a support surface, such as a grassy plot, a sandy beach, a hard surface or the like. When it is desired to move the chair 10 using the wheels, all that need be done is to tilt the chair backward by an amount sufficient to assure that the wheels are rollingly engaging a supporting surface and so that the bottom portion of leg section 11*b* is lifted above the ground.

The chair may be transported with the wheel assemblies when the chair is in the folded or unfolded position, although the transport of the chair in the folded position, shown in FIG. 1*b* is the preferred position for wheeling the chair.

In the folded position, it is further possible to load items upon the webs 16 of the chair and to hold these items down by means of two or more bungee cords 40, 41, which are arranged, for example, in a crisscross fashion, as shown in FIG. 1*b*. The hooks 40*a*, 41*a* provided at opposite ends of the bungee cords are hooked onto the aluminum frame of the seat and back sections to hold down items such as a cooler, picnic basket, beach balls, sand pails, and another, preferably smaller beach chair, and so forth, greatly facilitating the use of the chair, not only as a beach chair, but further as a wheeled tote.

The wheel assemblies are light and do not add significant weight to the beach chair.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. In combination, a foldable aluminum chair having at least foldable legs and an assembly for converting said chair into a wheeled tote, said chair legs being comprised of substantially U-shaped hollow tubes comprised of a yoke and integral arms extending from the yoke, said arms pivotally mounted so that said legs are moveable between a collapsed position wherein the yokes lie adjacent to one another and an open position with the yokes displaced from one another for supporting the chair on a supporting surface;

said converting assembly comprising first and second pairs of brackets;

each bracket pair comprising first and second bracket halves, each bracket half having first and second arcuate-shaped, concave, tube receiving recesses having their longitudinal axes transverse to one another, and locking portions on opposite sides of said recesses;

fastening means extending through aligned openings in the locking portions of said first and second bracket halves of said first and second pairs of brackets each bracket pair respectively embracing an arm of one of said legs;

a tubular extension inserted into each cooperating pair of second recesses which receive and support one of said extensions;

each extension having openings on opposite diametric sides thereof, axle extending though the openings in each extension;

a pair of wheels mounted on each axle, said wheels being on opposite sides of said extension;

end caps locking each pair of wheels on their respective axle;

said bracket pairs being slidable along their respective integral arms;

first self-tapping fasteners extending through openings in said brackets for securing said brackets at a desired location along said leg arm; said extension being slidable within said brackets; and second self-tapping fasteners extending through further openings in said brackets for securing said extensions to project a desired distance from said brackets.

2. The combination of claim 1 wherein said brackets maintain said extensions so that a longitudinal axis of each extension lies transverse to the longitudinal axis of an associated leg arm.

3. The combination of claim 1 wherein said axles lie substantially along a common central axis.

4. The combination of claim 1 wherein said brackets are arranged at a position along said arms so that the wheels do not touch a horizontal surface on which said chair is standing on a supporting surface and said legs are in the open position.

5. The combination of claim 1 wherein said extensions are hollow and open at least at a free end thereof; and an end cap being snap-fitted into each free open end of said extensions to provide and aesthetically pleasing finish to each extension.

6. The combination of claim 1 wherein said chair is provided with webs arranged on the seat and back sections of said chair and coupled to a chair frame for supporting a person seated thereon;

said webs being capable of supporting bulky items placed thereon;

a plurality of bungee cords being hooked to said frame for holding said bulky items on said chair when the chair is folded; and said wheels engaging a supporting surface and said yoke being displaced above said supporting surface when said folded chair is tilted to a given angle relative to said supporting surface to permit said chair to be rolled along said supporting surface by said wheels without interference from any portion of the folded chair.

7. The combination of claim 1 wherein said brackets are positioned along said arms so that said wheels are displaced a given distance above a supporting surface when said legs are in the open position and the yokes are supporting the unfolded chair on said supporting surface.

8. A method of converting a folding aluminum chair into a wheeled tote, said chair having at least foldable legs and an assembly for converting said chair into a wheeled tote, said chair legs being comprised of substantially U-shaped hollow tubes comprised of a yoke and integral arms extending from the yoke, said arms pivotally mounted so that said legs are moveable between a collapsed position wherein the yokes lie adjacent to one another and an open position with the yokes displaced from one another for supporting the chair on a supporting surface, said method comprising:

a) providing first and second pairs of brackets, each bracket pair comprising first and second bracket halves, each bracket half having first and second arcuate-shaped, concave, tube receiving recesses having their longitudinal axes transverse to one another forming first and second sets of cooperating tube receiving recesses, and locking portions on opposite sides of said recesses;

b) mounting each pair of brackets on one of said legs so that the first set of the cooperating tube receiving recesses of each bracket half embraces an associated leg;

c) fastening the bracket halves of each bracket pair together with fasteners;

d) inserting a hollow tubular extension into each of the second set of cooperating tube receiving recesses of each bracket;

e) mounting an axle through openings in each extension so that a longitudinal axis of each axle is transverse to a longitudinal axis of its associated extension;

f) mounting first and second wheels on each axle on opposite sides of said extensions;

g) affixing locking caps on opposite ends of each axle to retain the wheels on its associated axle;

h) sliding the brackets along the arms to a desired location;

l) retaining each bracket at a desired location along its associated arms by inserting self-tapping fasteners through openings in said brackets to engage said arms; and j) retaining each extension to its associated bracket by inserting self-tapping fasteners through further openings in said brackets to engage said extensions.

9. The method of claim 8 wherein step (j) further includes moving each extension relative to its associated bracket to align said axles along a common axis prior to tightening said self-tapping fasteners.

* * * * *